United States Patent [19]

Bührer

[11] 3,970,138

[45] July 20, 1976

[54] PATTERN DEVICE INCLUDING AN UPPER TROUGH PATTERN FOR THE MANUFACTURE OF THE UPPER PART OF A FOUNDRY MOLD

[76] Inventor: Erwin Bührer, Vogelingasschen 40, 8200 Schaffhausen, Switzerland

[22] Filed: Aug. 29, 1974

[21] Appl. No.: 501,817

[30] Foreign Application Priority Data

Sept. 5, 1973 Switzerland ..... 12759/73

[52] U.S. Cl. ..... 164/244

[51] Int. Cl.[2] ..... B22C 19/00

[58] Field of Search ..... 164/244, 27, 29, 30, 164/241, 242, 243, 366, 397

[56] References Cited

UNITED STATES PATENTS

| | | | |
|---|---|---|---|
| 695,146 | 3/1902 | Davis | 164/244 |
| 3,256,571 | 6/1966 | Lund | 164/244 |

*Primary Examiner*—Ronald J. Shore
*Assistant Examiner*—Gus T. Hampilos
*Attorney, Agent, or Firm*—Toren, McGeady and Stanger

[57] ABSTRACT

The upper part of a foundry mold is manufactured by utilizing a pattern device which includes a gate pin having a guide hole therein which is adapted to engage a guide pin extending from the mold pattern of the foundry mold in order to retain the pattern device in place during production of the upper part of the foundry mold. An upper trough pattern may be mounted for axial movement relative to the gate pin. The upper trough pattern is configured to define a trough from which a plurality of gate pins may extend. By structuring at least two of the gate pins located at opposite ends of the trough with guide holes engaging guide pins extending from the mold pattern, rotation of the upper trough pattern about either of the guide pins may be prevented.

8 Claims, 7 Drawing Figures

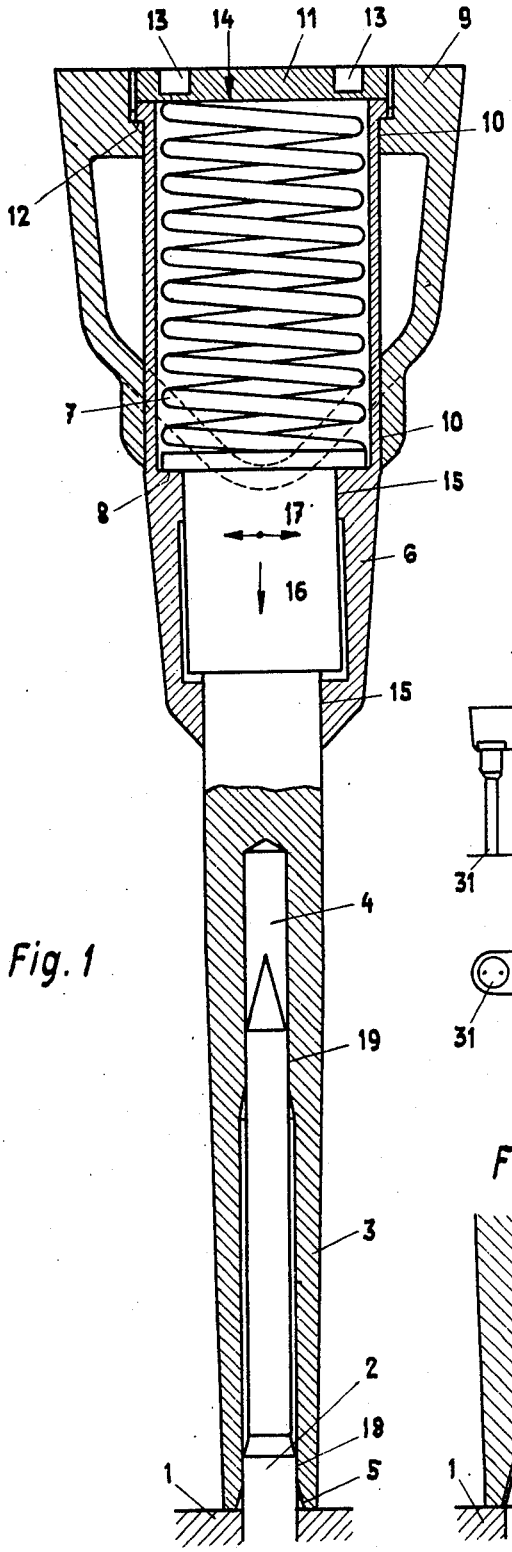
Fig. 1
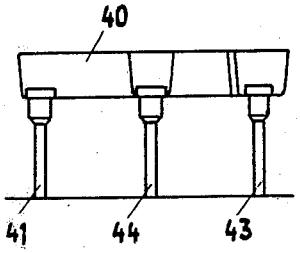
Fig. 7
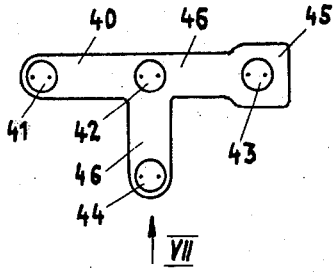
Fig. 6
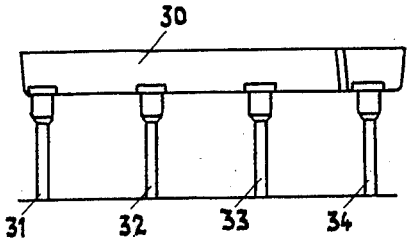
Fig. 5
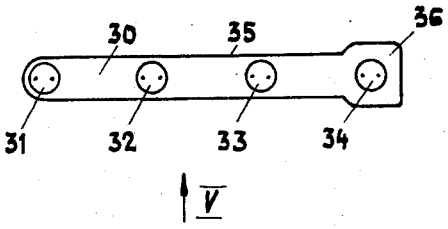
Fig. 4
Fig. 2
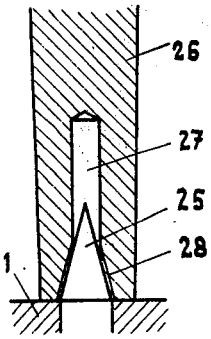
Fig. 3
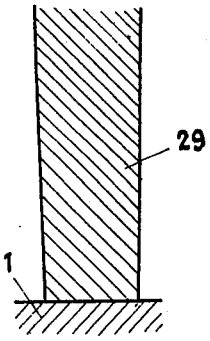

PATTERN DEVICE INCLUDING AN UPPER TROUGH PATTERN FOR THE MANUFACTURE OF THE UPPER PART OF A FOUNDRY MOLD

BACKGROUND OF THE INVENTION

The present invention relates generally to foundry molds and more particularly to a pattern device useful in the manufacture of the upper part of the foundry mold. The pattern device of the present invention is of the type utilizing an upper trough pattern which is configured to form a trough including a basin in the mold upper part, with at least two gates extending from the trough being formed by gate pins associated with the upper trough pattern.

In a casting method previously known from Swiss Pat. No. 320,832, liquid metal flows from a common mold basin through troughs on the upper side of the upper mold part into vertical gates and through channels located below and adjoining the parting plane into cavities of the mold.

In the terminology related to molds of this type, the basin located on the upper side which includes the troughs and the vertical gates is referred to as the upper trough in contrast to the horizontal lower trough which adjoins the parting plane of the mold and which is downstream of the vertical gates.

It is known to mold the upper trough by means of a separate upper trough pattern which is attachable to a match plate.

In addition to the pattern for the basin, the upper trough pattern also comprises a pattern for the troughs connecting the basin and the gates which is resiliently supported on the pattern device above the patterns for the gates. The resilient mounting of the upper trough pattern is so designed with regard to the gate pins forming the vertical gates that the upper trough pattern projects beyond the upper part of the mold after the mold is finished by compacting.

Pouring of molds having upper troughs of the type previously described has found considerable acceptance particularly with regard to the mass production of castings. This has occurred due to the fact that, if the upper trough cannot be used in a normal manner due to the location of the gates, the use of a special upper trough presents no problems from an economic point of view. Additionally, when filling molds for mass production operations, patterns for the upper troughs can be designed so as to include at least three gate pins which need not be positioned in a straight line. Therefore, the upper trough pattern can be safely placed on the pattern device without additional supporting pins.

However, if the conventionally known methods of filling a mold having an upper trough are applied to the production of castings of a special-order type, certain difficulties will be encountered. In order to maintain the cost of the pattern as low as possible, the pattern device must be made of partial matched plates which can be assembled. These partial matched plates, because of their production cost, should be selected of as small a size as possible, i.e. with the fewest possible patterns per partial pattern plate, inasmuch as experience has shown that the number of castings per customer order can be quite low. On the other hand, the size of partial match plates for the manufacture of special order casting is also influenced by the great diversity of dimensions occurring in individual patterns.

The requirement arising in the production of special order castings which utilize partial match plates of different sizes, wherein the number of molds required differs greatly depending on the respective quantities ordered, necessitates not only quick changeability of individual partial match plates, but also gives rise to demands for a casting system adaptable to the constantly changing demands made thereupon.

Further complications arise when liquid metals are poured whose analyses must be selected as a function of the wall thickness, or where mold cooling periods, i.e. the time between the pouring of a mold and the unpacking of a mold, must be flexible for reasons of casting structure.

Studies based upon the aforementioned conditions have led to recognition that the division of an entire pattern area into individual partial plates cannot be performed in an arbitrary manner. The most advantageous solution seems to involve the possibility of arranging all partial match plates on a main trough on both sides of the match plate plane in a random sequence. Only if the mold dimensions are particularly large does it normally become expedient to fill the mold by means of two separate main troughs, each having partial match plates on both sides arranged in an arbitrary sequence.

Accordingly, it will be seen that the filling of such molds by using upper troughs entails restrictions in that all gates must be arranged in most cases in a straight line because they must empty into the main trough. In practice, known pattern devices utilized in molding of upper troughs are provided in such cases with additional supporting pins so that they can be safely placed on the pattern device. If the aforementioned type of plate geometry is employed, these supporting pins must support themselves upon the actual pattern surface. As a result, the available pattern area cannot be fully utilized due to the location of the supporting pins which must be taken into consideration. Furthermore, the arrangement of the partial match plates in any desired sequence is also not possible for similar reasons. It is a particularly disturbing fact that the cavities automatically originating in the manufacture of the mold due to the supporting pins must be closed by the insertion of special cores into the upper trough before the mold is filled. Due to the fact that techniques involving pouring of molds having an upper trough are becoming in more widespread use, particularly for molds which are produced on turntable molding machines wherein the mold devices are subjected to severe horizontal acceleration during turning operations, the stability of the upper trough patterns must meet stricter and stricter requirements.

The present invention is intended to eliminate many of the above-mentioned disadvantages arising in the utilization of pattern devices having upper trough patterns. The device of the present invention is so structured that the gate pins may be configured to act as retaining pins thereby stabilizing the location of the pattern device and of the upper trough pattern. A particularly advantageous characteristic of the present invention arises by virtue of the fact that where more than two gate pins are involved, two of the gate pins positioned at opposite ends of an upper trough pattern may operate not only as retaining pins, but also as anti-rotation pins preventing rotation of the pattern device about either of the pins. By utilization of the present invention, a plurality of other gate pins may be positioned intermediate the two outermost pins without requiring additional structure to stabilize the pattern device.

SUMMARY OF THE INVENTION

Briefly, the present invention may be described as an improvement for a mold pattern device of the type utilized in the production of the upper part of a foundry mold, wherein there is included a mold pattern, an upper trough pattern configured to form a trough including a trough basin, and at least two gate pins configured to form at least two gates extending from the trough, with the trough being arranged to connect the basin with each of the gates. The improvement comprises the inclusion of at least one guide pin fixed to the mold pattern and extending therefrom into the upper mold part, and means defining a guide hole in at least one of the gate pins, with said at least one guide pin being fitted into the guide hole to retain the pattern device in place during production of the upper mold part.

Two of the gate pins of the pattern device may be formed with guide holes and each of them may be arranged to engage a guide pin extending from the mold pattern in order not only to retain the pattern device in place but also to prevent rotation thereof about the axis of either of the gate pins. Thus, in essence, two of the gate pins located on opposite sides of the mold may operate, respectively, one as a retaining pin and one as an anti-rotation pin.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWINGS

In the drawings:

FIG. 1 is a vertical sectional view of a pattern device in accordance with the present invention wherein the gate pin is designed as a retaining pin;

FIG. 2 is a partial sectional view of a gate pin of a pattern device in accordance with the present invention wherein the gate pin is provided with anti-rotation means;

FIG. 3 is a partial sectional view of a gate pin adapted to be placed flush upon the mold pattern of a mold assembly;

FIG. 4 is a schematic top view of an upper trough pattern;

FIG. 5 is an elevational view of the upper trough pattern of FIG. 4 viewed in the direction of the arrow V;

FIG. 6 is a schematic top view of another upper trough pattern; and

FIG. 7 is an elevational view of the upper trough pattern of FIG. 6 viewed in the direction of the arrow VII.

DETAILED DESCRIPTION OF THE PREFERRED EMBODIMENT

Referring now to the drawings, and particularly to FIG. 1, there is shown part of a mold assembly which includes a mold pattern 1 having a guide pin 2 affixed thereto in any appropriate manner. A gate pin 3 including a guide hole 4 extending thereinto is provided with a chamfer 5 at the lower end thereof which is positioned in abutment with the mold pattern 1. The gate pin 3 has a bushing 6 movably mounted thereon with the upper end of the gate pin 3 having a flange portion which is arranged to be pressed in abutment with a shoulder 8 of the bushing 6 by means of a spring 7. An upper trough pattern 9 having formed therein an annular opening 10 through which the bushing 6 extends includes a shoulder 12 against which a flange of the bushing 6 is pressed by means of a threaded cover 11 which is threadedly engaged within an upper opening in the upper trough pattern 9. Wrench holes 13 formed on the upper surface of the cover 11 operate to permit the cover 11 to be threadedly tightened into the pattern 9 by means of a special wrench.

When a compacting force is applied by means of a press (not shown) operating in the direction of the arrow 14 against the upper part of the mold assembly, the bushing 6 and the parts affixed thereto will move in the direction of the arrow 16 relative to the pin 3 by virtue of a sliding engagement between the pin 3 and the wall of a hole 15 formed in the bushing 6. The gate pin 3, which is supported upon the mold pattern 1, will not change its position taken in the vertical direction during the application of this compacting force due to its abutment against the mold pattern 1.

If the force of compaction which is applied is not exerted in a precisely vertical direction, which may result because the press motion is not exactly vertical or because the difference in the contours of the pattern may force sand movement in directions other than a purely vertical direction indicated by the arrow 16, it is possible that the upper trough pattern 9 may slip horizontally in directions indicated by the arrows 17 together with the bushing 6 and with the upper portion of the gate pin 3. Due to the fact that the pin 2 is firmly retained in the mold pattern 1, the gate pin 3 is constrained by a guide wall 18 to resist any horizontal motion at its lower end.

However, at the level of a guide wall 19 formed at the upper end of the guide hole 4 in the pin 3, the pin 2 may be subjected to resilient deflection in lateral or horizontal directions thereby permitting some lateral or horizontal play or motion in the upper part of the gate pin 3 as well as in the bushing 6 and the trough pattern 9.

As a result of the structure described above, it is therefore possible for the pattern device configured in accordance with the present invention and as shown in FIG. 1, to absorb without difficulty any horizontal forces applied in addition to vertical forces during the compaction of a mold assembly, within certain prescribed limits.

The gate pin depicted in FIG. 1 is intended to operate in the general sense of a retaining pin. However, in FIG. 2 there is shown a gate pin which is designed to act as an antirotation pin. In FIG. 2 the mold pattern 1 has affixed thereto a pin or bolt 25 which is of a conical configuration and extends upwardly projecting beyond the mold pattern 1 into the upper mold cavity. A gate pin 26 having a hole 27 which has its lower portion formed in conical configuration 28, is configured with a clearance space being provided between the pin 26 and the taper of the anti-rotation pin 25 when the gate pin 26 rests upon the mold pattern 1. This clearance is necessary in order that the gate pin 26 be in appropriate contact upon the mold pattern 1 during the production of the mold thereby preventing molding sand from penetrating between the under side of the gate pin and the surface of the mold pattern 1.

In FIG. 3 there is shown a gate pin structured in its simplest form which rests flush upon the mold pattern 1 and which, therefore, is not fixed in its position taken in the horizontal direction relative to the mold pattern.

FIGS. 4 and 5 show in schematic form an upper trough pattern 30 provided with four gate pins 31, 32, 33 and 34 which, in the horizontal projection of FIG. 4 lie in a straight line. A trough pattern 35 connects a basin pattern 36 with the gate pin 31.

FIGS. 6 and 7 show an upper trough pattern 40 of another embodiment of the invention, with the upper trough pattern being supported by gate pins 41, 42, 43 and 44. A basin pattern 45 connects with the pouring pins 41–44 via a trough pattern 46.

If the upper trough pattern is employed for a molding process which compacts a mold in two successive compacting operations, with the first compacting operation consisting of a preliminary compaction effected by shaking, it has been found to be expedient to produce the upper trough pattern, referring particularly to the trough pattern 9, the basin patterns 36, 45 or the trough patterns 35, 46, of an aluminum alloy. The reason for this is that such a casting made in the shape of the above mentioned parts, is lighter in weight than other economically feasible known metal alloys while providing the same type of service. It is expedient in this embodiment to make the bushing 6 of steel so that the surfaces of the hole 15 will have the required sliding properties relative to the gate pin 3 which may also expediently be made of steel.

It has been found particularly practical to produce the pin 2 from heat treated spring steel due to the fact that the proportional stress limits will be extremely high for this type of material.

Practical experience has shown that the accelerating and decelerating forces developing during the motion of a pattern device in an automatic molding machine result in application of a maximum torque to an upper trough pattern thereby requiring that the diameter of the pin 2 be designed upon the basis of the torque thus developed. Experience also shows that the length of the pin 2 which protrudes beyond the mold pattern 1 is determined by the horizontal deflections occurring in the directions of the arrow 17 which may be expected to occur. Mathematical computation will show that, at a given torque of the upper trough pattern and with a diameter for the pin 2 being selected in conformance therewith, the freedom of motion in the horizontal direction will be greater, the greater the distance between the guide 18 and the guide 19. Of course, other considerations related to the mounting of the pattern device must be taken into account in selecting the length of the pin 2 which should be selected to be no longer than is necessary.

The present invention exhibits advantages in that only gate pins, and no supporting pins, are required to fill a mold having an upper trough. This greatly simplifies the shape of the upper trough and improves in a hydrodynamic sense the process of pouring. The absence of supporting pins makes the unobstructed application of patterns to the mold surfaces possible. The closing of cavities caused in the upper trough by the supporting pins by means of cores is eliminated and is no longer necessary. Selection of the gate pin locations no longer requires the taking into consideration of the stability of the upper trough pattern. The only consideration which must now be taken into account is the most expedient plate geometry and the best arrangement of the gates.

The pin 2 may be round, rectangular or square in cross-sectional configuration and it may be reinforced in the vicinity of the mold pattern 1 at the opposite end of the guide 19, with the transition therefrom to the guide 19 being expediently formed in a conical configuration.

In summary, it will be seen that the present invention makes possible a highly advantageous application of the pouring of a mold with an upper trough, fully utilizing the advantages associated therewith, such advantages arising where molds involving the general production of special order castings are to be formed.

While a specific embodiment of the invention has been shown and described in detail to illustrate the application of the inventive principles, it will be understood that the invention may be embodied otherwise without departing from such principles.

What is claimed is:

1. In a pattern device for the production of the upper part of a foundry mold including a mold pattern, an upper trough pattern configured to form a trough with a trough basin, and at least two gate pins configured to form at least two gates extending from said trough, with said trough connecting said basin with said gates, said mold being subject to compaction after filling thereof with mold forming material, the improvement comprising a first guide pin fixed to said mold pattern and extending longitudinally therefrom into said upper mold part, wall means defining a guide hole in at least one of said gate pins, said first guide pin being fitted into said guide hole to retain said pattern device in place during production of said upper mold part, said first guide pin including a lower guide wall portion generally proximate said mold pattern and an upper guide wall portion located proximate the opposite end thereof and spaced from said lower guide wall portion, said guide hole being configured to firmly engage said first guide pin about said lower guide wall portion and said upper guide wall portion to impede lateral deflection of said at least one gate pin when said mold is subjected to compaction forces, with said wall means and said guide pin being shaped to define a longitudinally extending annular spacing therebetween extending continuously from said lower guide wall portion to said upper guide wall portion, said first guide pin having a predetermined diameter and a predetermined distance between said upper and lower guide wall portions, with said first guide pin diameter and said distance between said upper and lower guide wall portions being dimensioned in accordance with the magnitude of the lateral displacement forces exerted against said at least one gate pin during compaction of said mold, another of said gate pins having a guide hole therein, and a second guide pin spaced from said first pin and fixed to said mold pattern at a location to engage said guide hole in said another of said gate pins.

2. The improvement according to claim 1 wherein said at least one guide pin is configured to extend into said upper mold part to a sufficient degree to impart a lateral flexibility thereto adequate to permit limited lateral movement of said upper trough pattern during production of said upper mold part.

3. The improvement according to claim 1 wherein said at least one gate pin is positioned to extend through said upper mold part between said mold pattern and said upper trough pattern, said pattern device including means mounting said upper trough pattern upon said at least one gate pin to permit relative movement therebetween axially of said at least one gate pin.

4. The improvement according to claim 1 wherein said at least one gate pin has one end abutting said mold pattern and an opposite end having said upper trough pattern mounted thereon, and wherein said pattern device includes a bushing interposed between said at least one gate pin and said upper trough pattern, means fixing said bushing to said upper trough pattern, means defining a hole through which said at least one gate pin extends to permit relative movement axially of said at least one gate pin between said upper trough and said mold pattern, stop means for limiting movement of said upper trough pattern away from said mold pattern, and spring means interposed between said at least one gate pin and said upper trough pattern biasing said upper trough pattern away from said mold pattern.

5. The improvement according to claim 1 wherein said at least one guide pin has a first end affixed to said mold pattern and a second end opposite said first end extending into said guide hole, said first end of said at least one guide pin being larger in cross-sectional dimension than said second end.

6. The improvement according to claim 1 wherein said second guide pin is formed with a configuration tapering continuously from said mold pattern to the end of said second gate pin.

7. The improvement according to claim 1 wherein said at least two gate pins are arranged together with said upper trough pattern to define one of said at least two gates in direct flow communication with said trough basin with the other of said at least two gates spaced therefrom, said pattern device including two guide pins, with each of said at least two gate pins having means defining a guide hole therein, each of said guide holes having fitted therein, respectively, one of said two guide pins whereby rotation of said pattern device about either of said guide pins may be prevented during production of said upper mold part.

8. The improvement according to claim 7 wherein said pattern device includes more than said at least two gate pins with said at least two gate pins being located at opposite ends of said upper trough pattern and having each of said additional gate pins located therebetween.

* * * * *